US008549677B2

(12) United States Patent
Weigen et al.

(10) Patent No.: US 8,549,677 B2
(45) Date of Patent: Oct. 8, 2013

(54) AUTOMATIC WATER FLUSHING CONTROL DEVICE AND ITS FAUCET

(75) Inventors: Chen Weigen, Shanghai (CN); Def Xiong, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 280 days.

(21) Appl. No.: 12/967,502

(22) Filed: Dec. 14, 2010

(65) Prior Publication Data

US 2012/0012207 A1 Jan. 19, 2012

(30) Foreign Application Priority Data

Dec. 16, 2009 (CN) ..... 2009 1 0201203

(51) Int. Cl.
*F16K 31/126* (2006.01)

(52) U.S. Cl.
USPC ..... 4/313; 4/623; 251/30.03

(58) Field of Classification Search
USPC ..... 251/30.01–30.05, 129.04; 137/801; 4/313, 623
See application file for complete search history.

(56) References Cited

U.S. PATENT DOCUMENTS 3,821,967 A * 7/1974 Sturman et al. ..... 251/30.02
4,915,347 A * 4/1990 Iqbal et al. ..... 251/30.03
4,955,535 A * 9/1990 Tsutsui et al. ..... 251/129.04
5,125,621 A * 6/1992 Parsons et al. ..... 251/30.03
5,169,118 A * 12/1992 Whiteside ..... 4/623
5,341,839 A * 8/1994 Kobayashi et al. ..... 4/623
5,904,180 A * 5/1999 Iwamura et al. ..... 251/129.15
5,911,240 A * 6/1999 Kolar et al. ..... 137/801
5,918,855 A * 7/1999 Hamanaka et al. ..... 4/623
6,619,320 B2 * 9/2003 Parsons ..... 4/623
7,156,363 B2 * 1/2007 Parsons et al. ..... 251/30.04

* cited by examiner

*Primary Examiner* — John Bastianelli
(74) *Attorney, Agent, or Firm* — Foley & Lardner LLP

(57) ABSTRACT

A control device for automatic water discharge installed at position where water is discharged in apparatus for automatic water discharge in a kitchen and sanitary environment is provided. The device comprises a housing, a sensor unit disposed inside the housing, a water discharge unit, and an electromagnetic valve assembly. The housing comprises a first holding chamber configured to receive the sensor unit, a second holding chamber configured to receive the electromagnetic valve assembly, a third holding chamber configured to receive the water discharge unit, and a water intake chamber. The sensor unit comprises a circuit board and a sensor set at the circuit board. The circuit board is provided with a processor. The electromagnetic valve assembly comprises an electromagnetic valve electrically connected with the circuit board and a diaphragm unit. Motion of the diaphragm unit controls connecting and blocking between the water intake chamber and the third holding chamber to respectively realize water discharge or to stop water. The control device for automatic water discharge is designed as compact structures, and is conducive to the miniaturization of products.

20 Claims, 9 Drawing Sheets

AUTOMATIC WATER FLUSHING CONTROL DEVICE AND ITS FAUCET

CROSS-REFERENCE TO RELATED PATENT APPLICATIONS

This application is related to and claims priority to Chinese Patent Application No. 200910201203.6, filed Dec. 16, 2009, and incorporated herein by reference in its entirety.

BACKGROUND

The present disclosure relates to a control device for automatic water discharge and an apparatus for automatic water discharge which contains the above control device applied in kitchen and sanitation uses, such as an automatic sensing faucet, etc.

Automatic sensing technology is widely used in water discharge apparatuses in kitchens, sanitation, etc., for instance, in faucets, urinals, and so on. In the prior art, an automatic sensing faucet typically comprises a faucet body; and a detecting sensor for detecting whether there is any object (such as the hands of a user) entering/leaving the sensing area, an electromagnetic valve, and a control unit are connected with the faucet body. The detecting sensor can be a traditional infrared sensor, position sensing device (PSD), microwave detecting sensor, or ultrasonic wave detection sensor, etc. General speaking, the sensor is installed at the faucet outlet or on the faucet body. The electromagnetic valve and the control unit are installed under the basin of faucet.

The automatic sensing faucet has many elements, and both the electromagnetic valve and the control unit need to be installed below the basin, which is inconvenient during installation and subsequent maintenance, and is not conducive to miniaturization of the product.

SUMMARY

One embodiment of the present disclosure relates to providing a new type of control device for automatic water discharge and an apparatus for automatic water discharge including the control device.

Another embodiment of the present disclosure relates to a control device for automatic water discharge, mounted at a position where water is discharged from an automatic water discharge device in a kitchen or sanitation environment. The control device comprises a housing, a sensor unit contained inside the housing, a water discharge unit, and an electromagnetic valve assembly. The housing comprises a first holding chamber for containing the sensor unit, a second holding chamber for containing the electromagnetic valve assembly, a third holding chamber for containing the water discharge unit, and a water intake chamber. The sensor unit comprises a circuit board provided with a processor and a sensor coupled to the circuit board. The electromagnetic valve assembly comprises an electromagnetic valve electrically connected with the circuit board and a diaphragm unit cooperated with the electromagnetic valve. Motion of the diaphragm unit controls connecting or blocking between the water intake chamber and the third holding chamber to respectively discharge water or stop water.

According to one embodiment, the electromagnetic valve comprises a valve cover and an electromagnet disposed inside the valve cover. The electromagnet comprises a cylinder body, a valve core contained inside the cylinder body, and a coil set at two sides of the valve core. A cavity is formed between the valve cover and the diaphragm unit.

According to one embodiment, a water intake channel connected with the cavity and a water leak channel connected with the third holding chamber are set into the valve cover. Movement of the valve core controls connecting and blocking between the water intake channel and the water leak channel.

According to one embodiment, the electromagnet is horizontally set inside the valve cover; both the water intake channel and the water leak channel are positioned at the side of the valve cover adjacent to the valve core.

According to one embodiment, a leak hole connected to both the second holding chamber and third holding chamber is provided in the housing. The water leak channel is connected to the third holding chamber through the leak hole.

According to one embodiment, the diaphragm unit comprises a moving diaphragm and a moving plate provided on the moving diaphragm. A water supplement hole connected with the cavity is set at the moving plate.

According to one embodiment, a pin fitted with the water supplement hole is set at the diaphragm unit.

According to one embodiment, the circuit board comprises a first portion and a second portion. The sensor is installed at the first portion while the processor is installed at the second portion. After the sensor unit is mounted to the housing, the first portion of the circuit board is positioned at the surface of the front end of the housing with the sensor facing towards the sensing area, while the second portion is positioned inside the first holding chamber.

According to one embodiment, the circuit board is a flexible circuit board.

According to one embodiment, openings of the first and third holding chambers are positioned at the front end of the housing while openings of the second holding chamber and the water intake chamber are positioned at the back end of the housing. The water intake chamber is located at a first side of the second holding chamber.

Another embodiment of the present disclosure relates to an apparatus for automatic water discharge comprising a control device for automatic water discharge set at the position where the water is discharged from an automatic water discharge device. The control device for automatic water discharge is connected with a water pipe of the apparatus for automatic water discharge and comprises a housing, a sensor unit contained inside the housing, a water discharge unit, and an electromagnetic valve assembly. The housing comprises a first holding chamber for containing the sensor unit, a second holding chamber for containing the electromagnetic valve assembly, a third holding chamber for containing the water discharge unit, and a water intake chamber connected with the water pipe. The sensor unit comprises a circuit board provided with a processor and a sensor set at the circuit board for detecting if a user enters/leaves the sensing area of the apparatus for automatic water discharge. The electromagnetic valve assembly comprises an electromagnetic valve electrically connected with the circuit board and a diaphragm unit cooperated with the electromagnetic valve. The motion of the diaphragm unit controls connecting and blocking between the water intake chamber and the third holding chamber to discharge water or stop water, respectively.

According to one embodiment, the electromagnetic valve comprises a valve cover and an electromagnet set inside the valve cover. The electromagnet comprises a cylinder body, a valve core contained inside the cylinder body and a coil set at two sides of the valve core. A cavity is formed between the valve cover and the diaphragm unit.

According to one embodiment, a water intake channel connected with the cavity and a water leak channel connected with the third holding chamber are set into the valve cover.

The movement of the valve core controls opening and closing between the water intake channel and the water leak channel.

According to one embodiment, a leak hole connected to both the second holding chamber and third holding chamber is provided in the housing. The water leak channel is connected to the third holding chamber by means of the leak hole.

According to one embodiment, the electromagnet is horizontally set inside the valve cover. The water intake channel and the water leak channel are positioned at the side of valve cover adjacent to the valve core.

According to one embodiment, the diaphragm unit comprises a moving diaphragm and a moving plate at the moving diaphragm. A water supplement hole connected with the cavity is set at the moving plate.

According to one embodiment, the diaphragm unit also comprises-a pin fitted with the water supplement hole.

According to one embodiment, the circuit board comprises a first portion and a second portion. The sensor is installed on the first portion while the processor is installed on the second portion. After the sensor unit is mounted to the housing, the first portion of the circuit board is positioned at the surface of the front end of the housing with the sensor facing towards sensing area, while the second portion is positioned inside the first holding chamber.

According to one embodiment, the circuit board is a flexible circuit board.

According to one embodiment, openings of the first and third holding chambers are positioned at the front end of the housing while openings of the second holding chamber and water intake chamber are positioned at the back end of the housing. The water intake chamber is located to one side of the second holding chamber.

According to one embodiment, the apparatus for automatic water discharge is an automatic sensing faucet.

Compared with the prior arts, the control device for automatic water discharge of the present invention is compact, and it is conducive to miniaturization of product. The apparatus for automatic water discharge having the control device installed is more compact, which provides convenient maintenance and installation.

DETAILED DESCRIPTION

Exemplary embodiments of the present invention will be clearly described referring to the attached drawings. Elements having the same structure or function are marked with the same number. It is understood that the attached drawings are just for the description of the exemplary embodiments, not limitations of the present invention. Additionally, the attached drawings may or may not be drawn in proportion.

Figure 1:
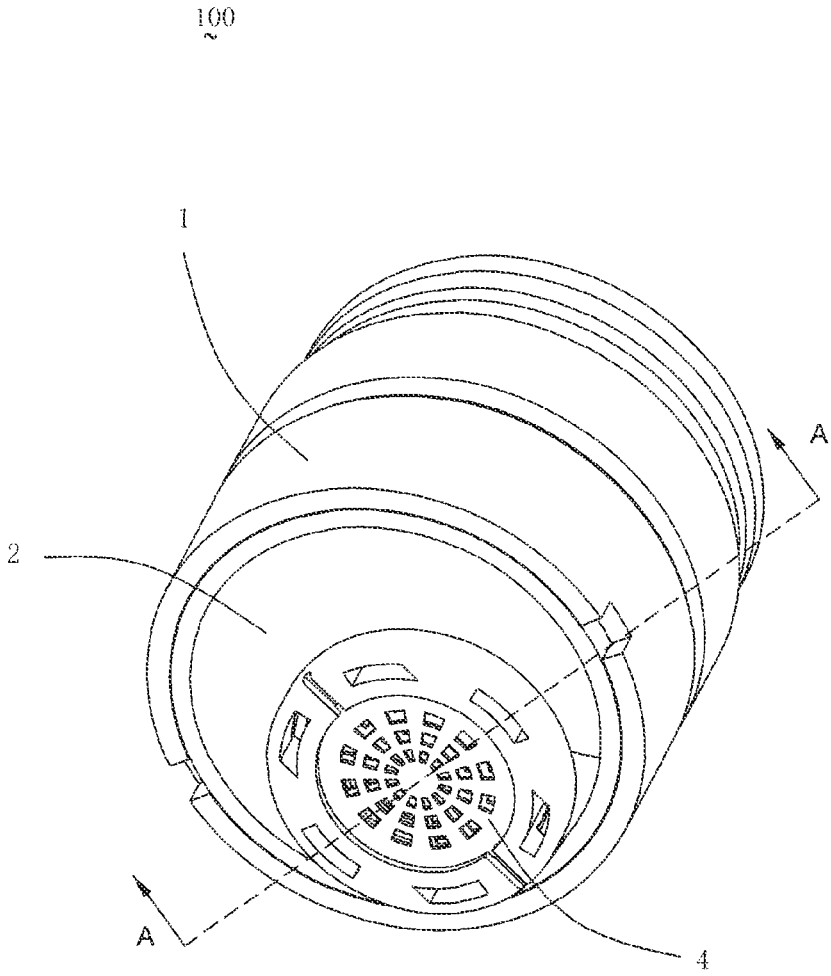
FIG. 1 is a perspective view of a control device for automatic water discharge, according to an exemplary embodiment.
Figure 2:
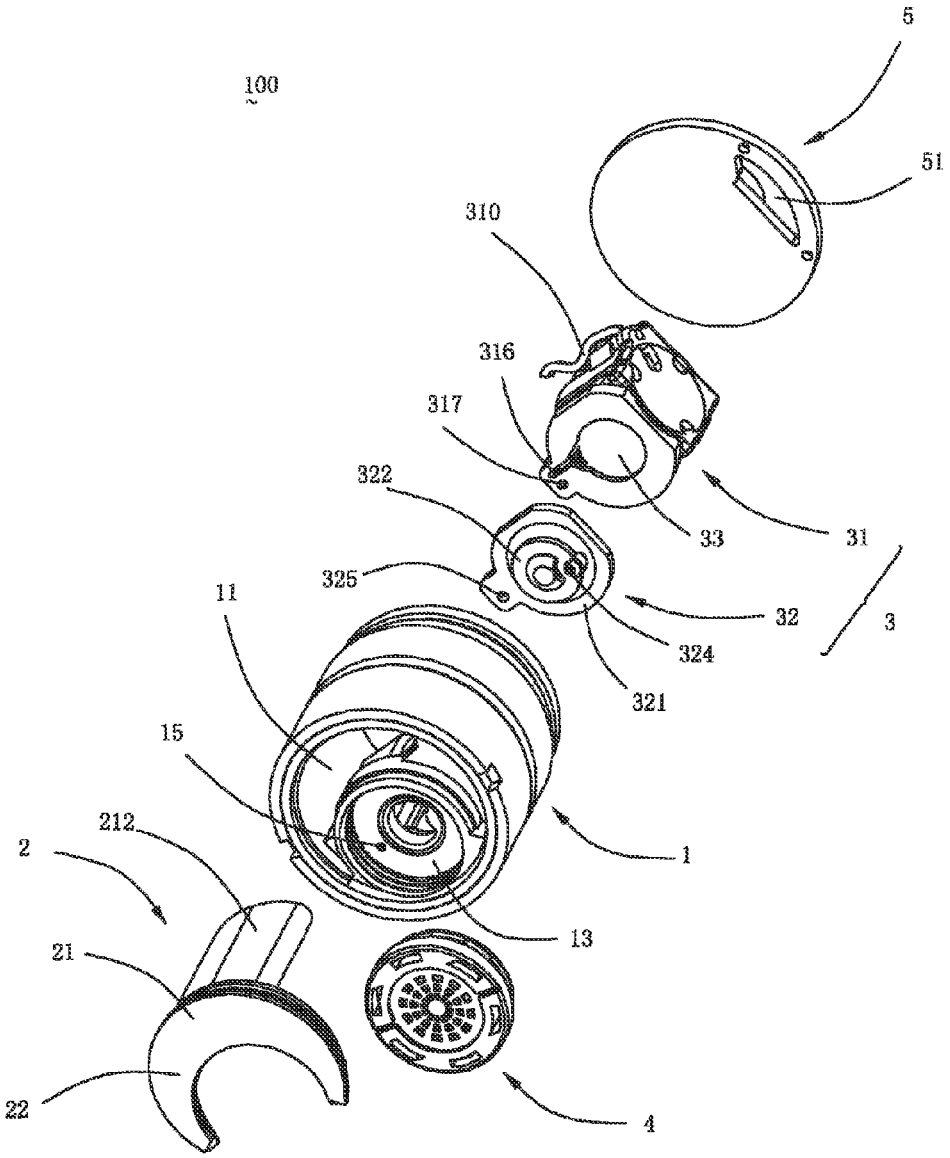
FIG. 2 is an exploded view of the control device of FIG. 1.
Figure 3:
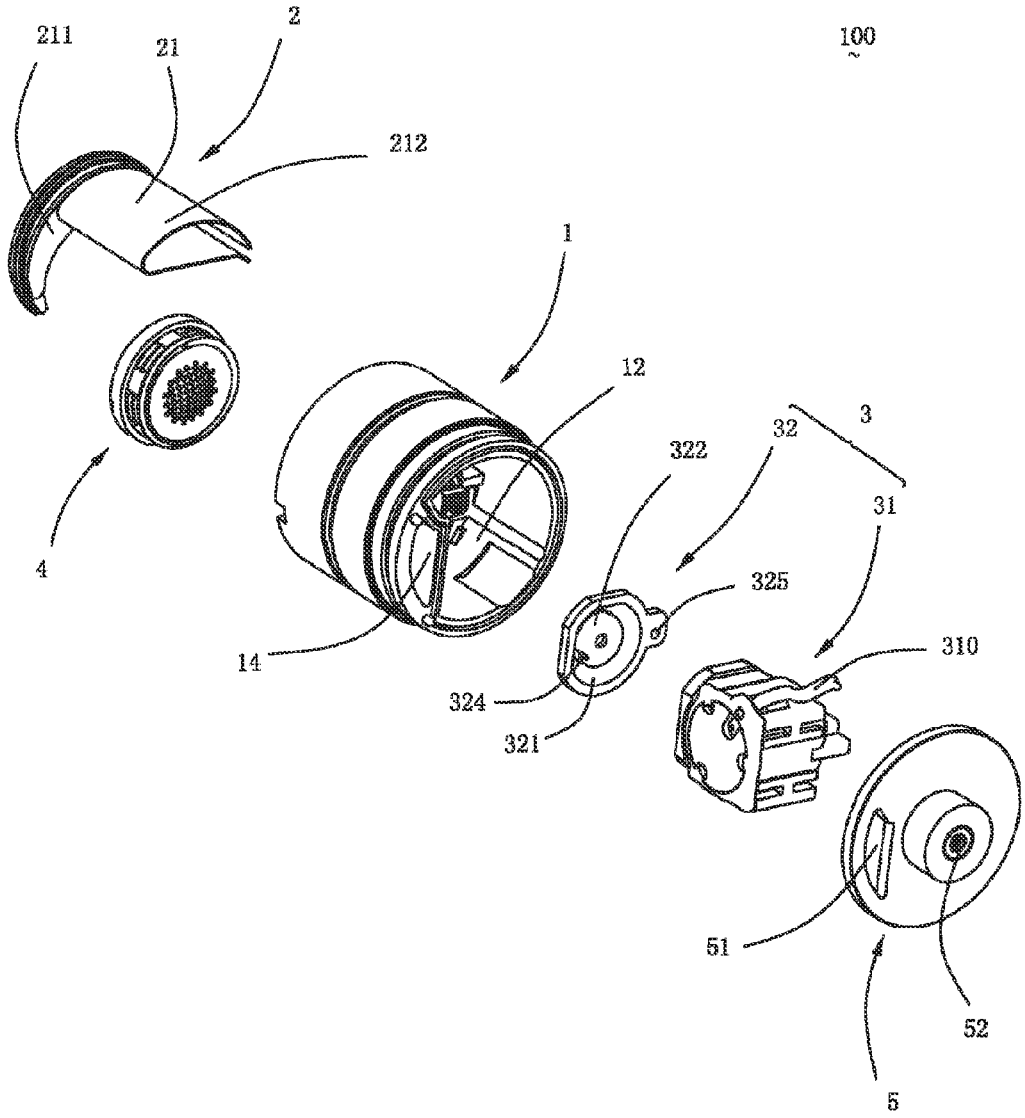
FIG. 3 is a view of the control device of FIG. 2 from another side.

As shown from FIG. 1 to FIG. 3, an exemplary embodiment of the present invention relates to a control device 100 for automatic water discharge which overcomes the shortcomings of the prior art, has the high integration and lends itself to miniaturization of product. Another embodiment relates to an apparatus for automatic water discharge which contains said control device 100 (such as automatic sensing faucet, etc., shown as FIG. 9).

The control device 100 for automatic water discharge comprises housing 1, sensor unit 2 installed in the housing 1, electromagnetic valve assembly 3 electrically connected with the sensor unit 2, and water discharge unit 4. The control device 100 for automatic water discharge also comprises an end cover 5 which works as a seal.

Housing 1 is shown to be cylindrical and has several holding chambers. It comprises a first holding chamber 11, configured to hold sensor unit 2, a second holding chamber 12, configured to hold electromagnetic valve assembly 3, a third holding chamber 13, configured to hold water discharge unit 4, and water intake chamber 14 which connects with the water pipe of the apparatus for automatic water discharge. Water intake chamber 14 is shown to one side of second holding chamber 12. This makes the structure more compact. Housing 1 also has a leak hole 15 which connects second holding chamber 12 and third holding chamber 13.

Housing 1 comprises front and back ends, wherein the front end faces the user, and the back end is set in the apparatus for automatic water discharge and connects with water pipe. The openings of the first holding chamber 11 which holds sensor unit 2, and third holding chamber 13, which holds water discharge unit 4, are at the front end of housing 1; the openings of second holding chamber 12, which holds electromagnetic valve assembly 3, and the water intake chamber 14 are at the back end of housing 1. In an installed position, sensor unit 2 and water discharge unit 4 are approximately located at the front end of housing 1.

Sensor unit 2 comprises circuit board 21, which electrically couples with electromagnetic valve 31, and a sensor (not shown on the drawings) which is set in the circuit board 21. Wherein circuit board 21 also has processors and other electronic elements. The sensor may be an infrared sensor having an infrared emitter and an infrared receiver. According to other embodiments, the sensor can be a microwave sensor, an-ultrasonic sensor, or any suitable sensor configured to detect whether the objects enter or leave the sensing area. Circuit board 21 comprises a first portion 211 and second portion 212. The sensor is set on first portion 211; an electronic element (device), such as the processor may be set on second portion 212. A light-passing board 22 is also set on the external surface of first portion 211 of said sensor. The second portion 212 may be disposed in first holding chamber 11, and light-passing board 22 of first portion 211 may form a surface of the front end of housing 1.

In an exemplary embodiment, the circuit board 21 is a flexible circuit board, which enables second portion 212 to be foldable or curved, so second portion 212 can be accommodated in the first holding chamber 11 expediently. As shown, both the configuration of water discharge unit 4 and housing 1 are cylindrical. The shape of the first portion 211 of circuit board 21 and the light-passing board 22 are somewhat crescent-shaped, which enables the first part 211 and the light-passing board 22 to cooperate with water discharge unit 4 and to be set in the front surface of the front end of housing 1.

Electromagnetic valve assembly 3 comprises an electromagnetic valve 31 and diaphragm unit 32 which cooperates with the electromagnetic valve 31. The diaphragm unit 32 may be moved by means of opening and closing electromagnetic valve 31. As shown, the diaphragm unit 32 is set under the electromagnetic valve 31.

Figure 4:
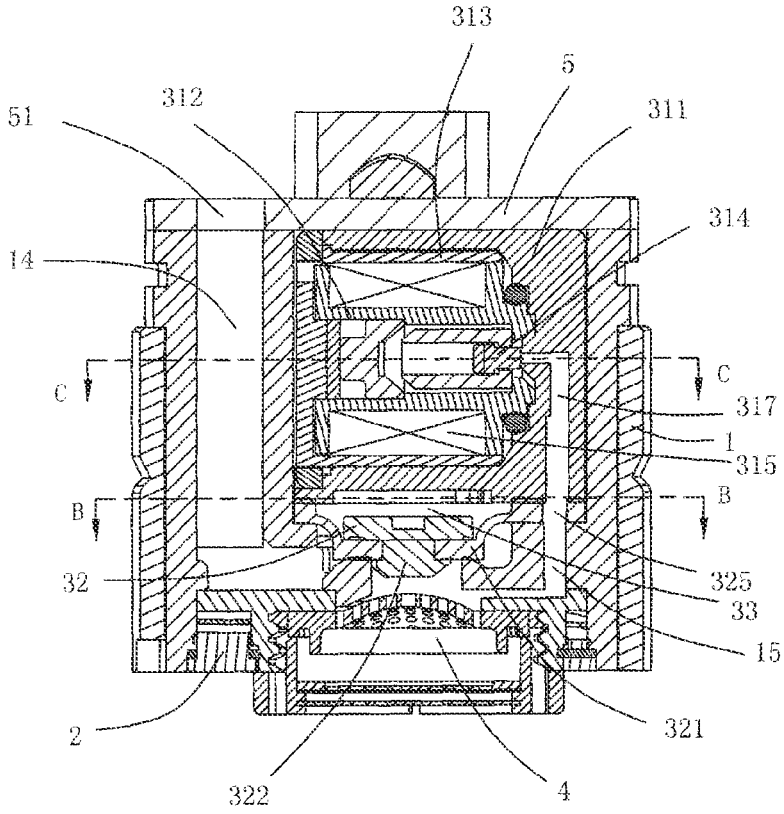
FIG. 4 is a section view of the control device of FIG. 1 along section line A-A of FIG. 1.
Figure 5:
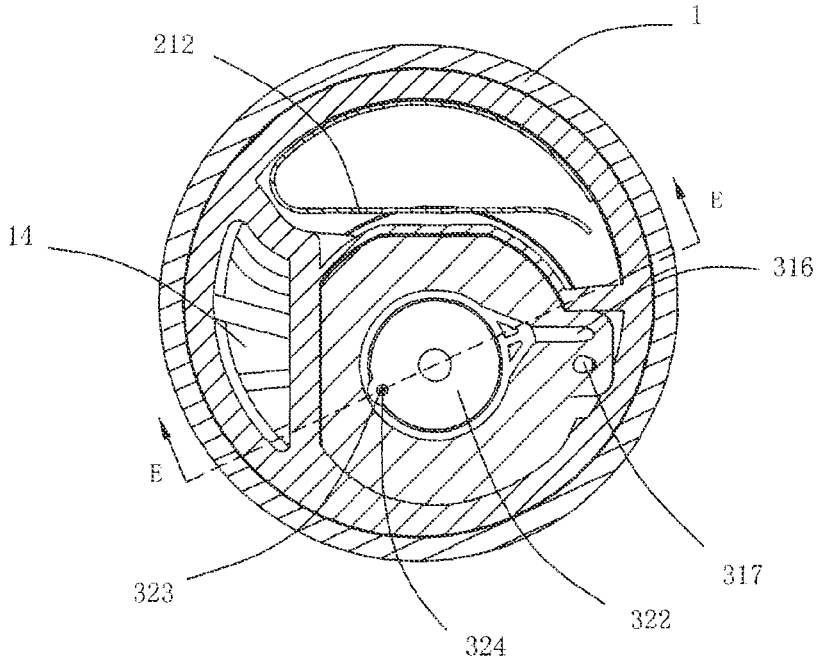
FIG. 5 is a section view of the control device of FIG. 1 along section line B-B of FIG. 4.
Figure 6:
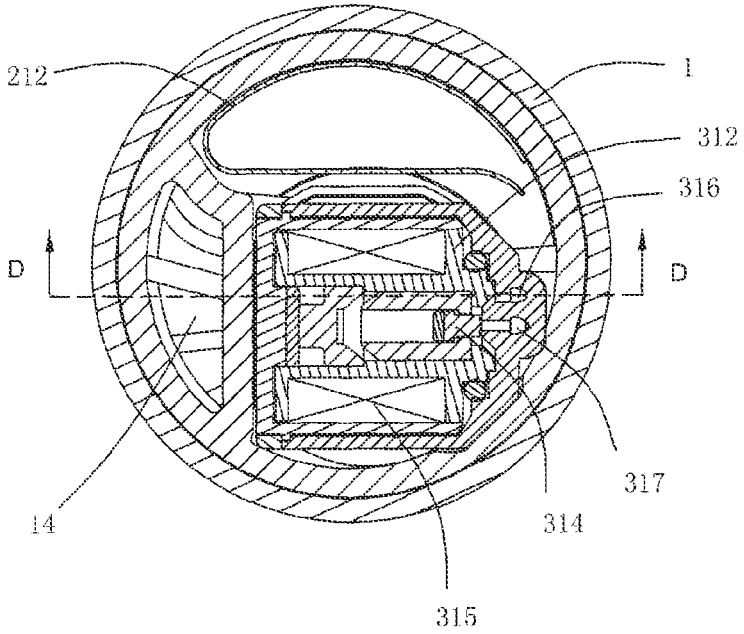
FIG. 6 is a section view of the control device of FIG. 1 along section line C-C of FIG. 4.

FIG. 4 is a section view along the A-A line on FIG. 1, and FIG. 5 and FIG. 6 are section views along the B-B line and C-C line on FIG. 4, shown according to an exemplary embodiment. The A-A line is along the line through the center of moving plate 322 and the center of water leak channel 317. The B-B line passes through cavity 33. The C-C line passes through the center of valve core 314 of electromagnet 312.

According to the embodiment shown in FIG. 4, the electromagnetic valve 31 comprises a valve cover 311 and electromagnet 312 located in the valve cover 311. As shown, the diaphragm unit 32 is located under valve cover 311, and the cavity 33 is formed between diaphragm unit 32 and valve cover 311. The electromagnet 312 comprises a cylindrical body 313, a movable valve core 314 located in the cylindrical body 313, and coil 315 set on the two sides of valve core 314. The valve core 314 can move back and forth under the electromagnetic force by supplying or cutting off the power of electromagnetic valve 31. Further, a cable 310 which connects electrically with circuit board 21 may be set on the electromagnetic valve 31.

Figure 7:
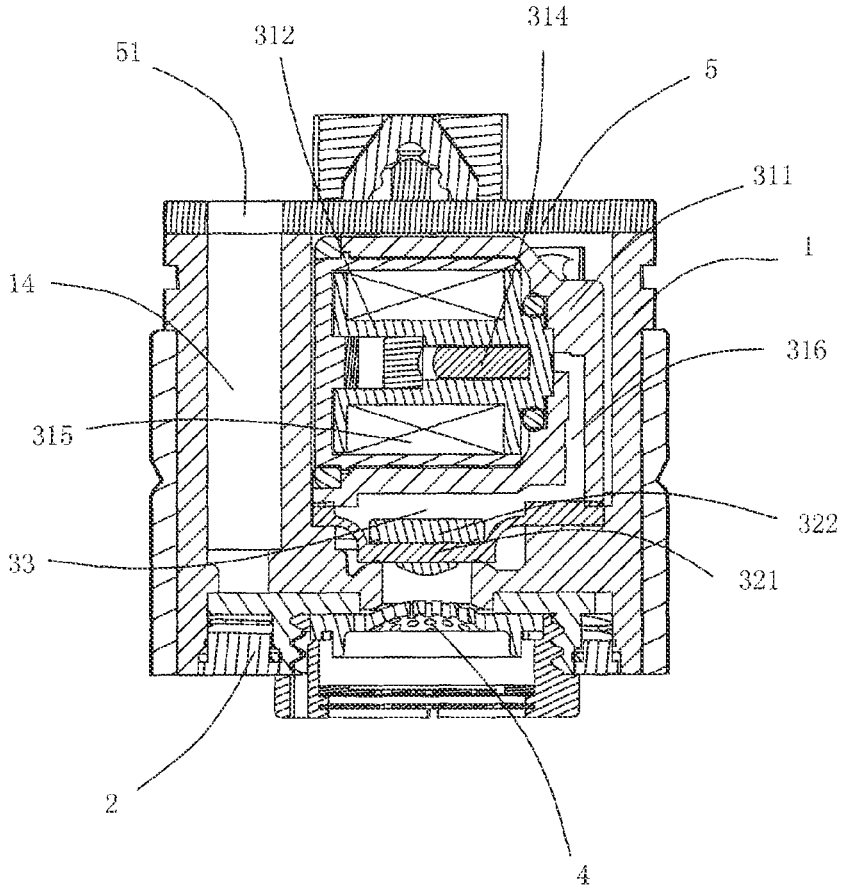
FIG. 7 is a section view of the control device of FIG. 1 along section line D-D of FIG. 4.

FIG. 7 is a section view along the D-D line on FIG. 6, shown according to an exemplary embodiment. The D-D line passes through the water intake channel 316.

As shown in FIG. 5 to FIG. 7, the water intake channel 316, connected with the cavity 33, and the water leak channel 317, connected with the third holding chamber 13, are set into the valve cover 311. After the water discharge unit 4 is installed into third holding chamber 13, the water leak channel 317 is connected to third holding chamber 13, namely, the water leak channel 317 is connected to water discharge unit 4. When the electromagnetic valve 31 is closed, the valve core 314 protrudes out. Water is blocked and can not flow through water intake channel 316 to water leak channel 317, i.e., water intake channel 316 and water leak channel 317 are disconnected. When electromagnetic valve 31 is opened, the valve core 314 retracts into cylindrical body 313. The water intake channel 316 is connected with the water leak channel 317. In another embodiment, a sealing element is set around the free end of the valve core 314, thereby improving the sealing effectiveness while the water intake channel 316 and the water leak channel 317 are blocked by the valve core 314.

The diaphragm unit 32 further comprises a moving diaphragm 321 and a moving plate 322 mounted on the moving diaphragm 321. The moving plate 322 has a water supplement hole 323 connected with the cavity 33. The moving diaphragm 321 may be made from soft rubber materials, and the moving plate 322 may be made from hard plastic materials. In one embodiment, the diaphragm unit 32 comprises a pin 324 fitted through water supplement hole 323 to protect the water supplement hole 323 from being blocked by foreign matter (see FIG. 8). When the diaphragm unit 32 operates, the moving plate 322 causes the moving diaphragm 321 to move.

In one embodiment, the electromagnet 312 is horizontally set in valve cover 311, and water intake channel 316 and water leak channel 317 are positioned at the side of valve cover 311 adjacent to the valve core 314. In other embodiments, the electromagnet 312 can be installed with any suitable angle. The water intake channel 316 and water leak channel 317 can be appropriately adjusted according to where said electromagnet 312 is mounted.

A water inlet 51 connected with water intake chamber 14 is set at the end cover 5. The end cover 5 seals the back end of housing 1 except the water intake chamber 14. A power cable (not shown on the drawings) connected with the circuit board 21 exits by passing through the cable opening 52 on the end cover 5, and may then be connected to an external power source of the apparatus for automatic water discharge. The external power source can be a direct current supply or an alternating current (e.g., mains) supply.

In another embodiment, the end cover 5 is not required; it can be substituted by any sealing material which can effectively seal housing 1 except the water intake chamber 14.

Moreover, as the water discharge part of the water discharge device, water discharge unit 4 can be a bubbler installed in automatic sensing faucets or a sprinkler installed in automatic sensing urinals.

Sensor unit 2 is installed into the first holding chamber 11 through the front end of the housing 1. The first portion 211 of circuit board 21 may be installed such that the sensor is positioned at the surface of the front end of the housing 1 to locate the sensor at an ideal position. The housing 1 seals the circuit board 21 in the first holding chamber 11 to prevent water from entering the circuit board 21.

The water discharge unit 4 is installed in the third holding chamber 13 through the front end of the housing 1, and the outer side of the water discharge unit 4 is positioned at the surface of the front end of the housing 1. In another embodiment, threads are provided on the outer face of water discharge unit 4 and the inner side of the third holding chamber 13. The water discharge unit 4 is connected to housing 1 by the threads. The water discharge unit 4 can be connected to housing 1 by other means, such as screws or welding, etc.

Figure 8:
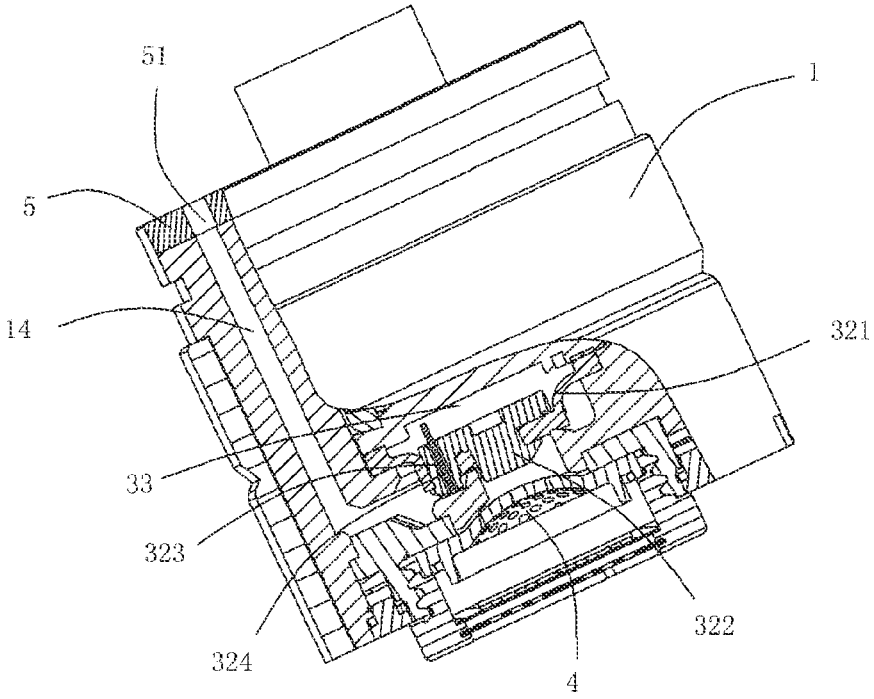
FIG. 8 is a section view of the control device of FIG. 1 along section line E-E of FIG. 5.

FIG. 8 is a section view along section line E-E of FIG. 5, shown according to an exemplary embodiment. The section line E-E is along the straight line through the center of water supplement hole 323 and the diaphragm unit 32. As shown, the electromagnetic valve assembly 3 is installed into the second holding chamber 12 through the back end side of the housing 1. After the electromagnetic valve assembly 3 is installed into the second holding chamber 12, the diaphragm unit 32 is positioned between water intake chamber 14 and the third holding chamber 13. Motion of the diaphragm unit 32 controls the connecting and blocking between water intake chamber 14 and the third holding chamber 13. After the water discharge unit 4 is installed into the third holding chamber 13, water intake chamber 14 and the third holding chamber 13 are connected to each other or blocked, that is, water intake chamber 14 and water discharge unit 4 are connected with each other or blocked. After receiving water pressure from water in the cavity 33, the diaphragm unit 32 is pressed to the position between water intake chamber 14 and the third holding chamber 13, thereby blocking the connection between water intake chamber 14 and the third holding chamber 13. Water in the water intake chamber 14 is sealed in water intake chamber. As shown in FIG. 8, the diaphragm unit 32 is right on the position to block the connection between water intake chamber 14 and the third holding chamber 13. When water in the cavity 33 is released, the diaphragm unit 32 moves backward into the cavity 33. The water intake chamber 14 is connected with the third holding chamber 13. Thus, water in water intake chamber 14 will flow into the third hold chamber 13 and be discharged through the water discharge unit 4.

After the electromagnetic valve assembly 3 is installed in housing 1, the leak hole 15 is connected with water leak channel 317. Therefore, water in the water leak channel 317 can flow into the third holding chamber 13 through the leak hole 15 and is discharged through water discharge unit 4. In one embodiment, to ensure sealing, a portion of diaphragm unit 32 is located between water leak channel 317 and leak hole 15. A small hole 325 is provided at diaphragm unit 32, thus small hole 325 is connected with water leak channel 317 and leak hole 15 to form a channel for water flow. Water leak channel 317 can also be directly connected with leak hole 15. Other sealing elements may be needed for sealing.

The end cover 5 is installed to the end side of the back end of housing 1 to seal electromagnetic valve assembly 3 and sensor unit 2. Water inlet 51 of end cover 5 is connected with water intake chamber 14 of housing 1.

Thus, assembling of the control device for automatic water discharge of the exemplary embodiment is completed.

For use, the control device 100 for automatic water discharge is installed in the an apparatus for automatic water discharge, such as automatic sensing faucet, automatic sensing urinal machine, and other automatic kitchen and sanitation water sources. The control device 100 for automatic water discharge is installed proximate the water discharging portion of the apparatus for automatic water discharge.

Figure 9:
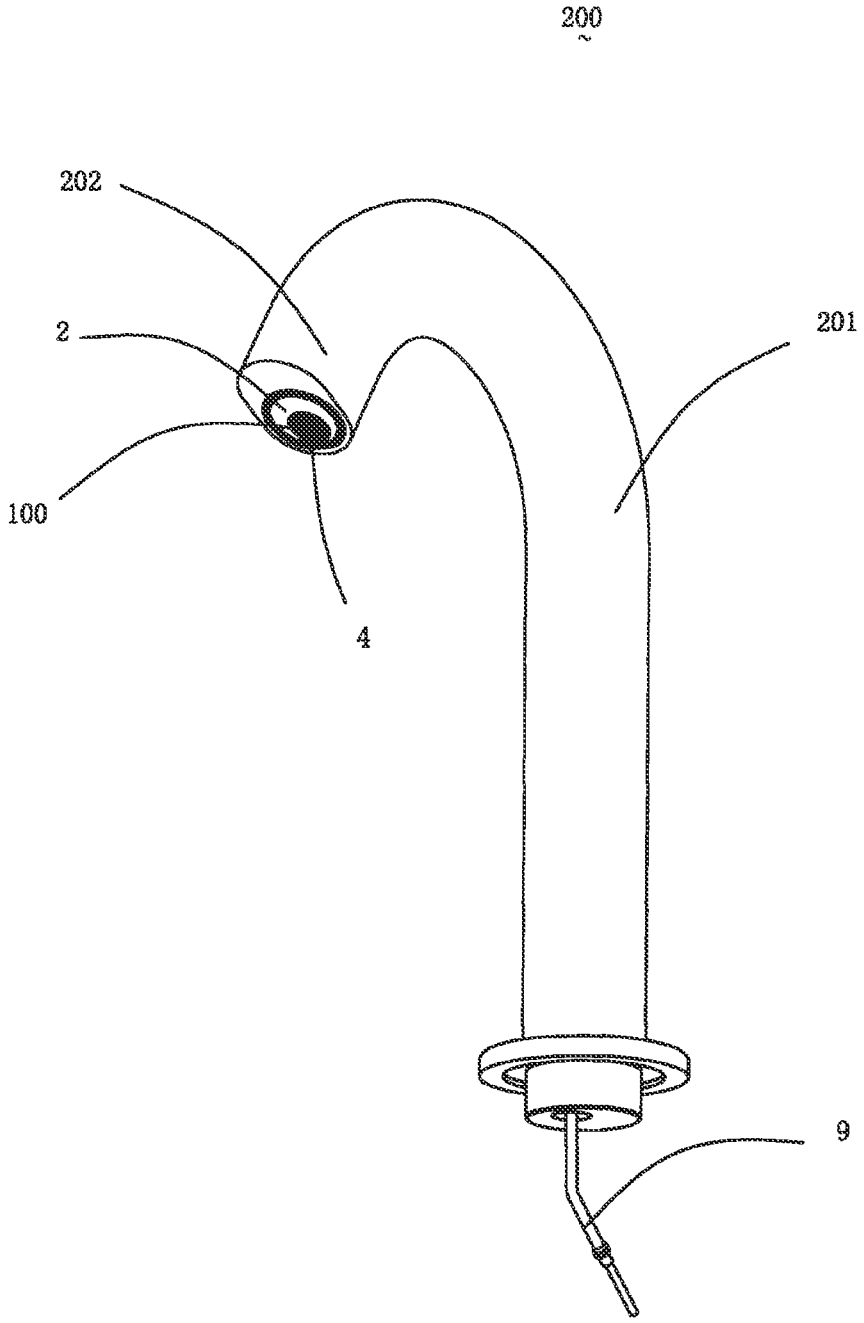
FIG. 9 is a perspective view of an automatic sensing faucet including the control device of FIG. 1 for automatic water discharge.

The following description describes use of the control device 100 for automatic water discharge in an automatic sensing faucet, according to an exemplary embodiment. With reference to FIG. 9, an automatic sensing faucet 200 comprises body 201 and water outlet 202. The control device 100 for automatic water discharge is installed proximate the position of water outlet 202 of automatic sensing faucet 200. The sensor unit 2 faces the sensing area of automatic sensing faucet 200, and water discharge unit 4 faces the working area of automatic sensing faucet 200. Power cable 9 is connected with an external power source (not shown in the drawings) through faucet body 201. The external power source may be direct current, and it may be placed under the basin or in faucet body 201 where automatic sensing faucet is installed. Furthermore, power and the volume conditions permitting, the external power source may be a direct current power source, for example, a lithium battery, which can directly be installed at the back end of housing 1 of control device 100 for automatic water discharge or directly in housing 1, thus is installed in water outlet 202 of faucet 200 together with the control device 100. Therefore, there is no cable 9 which passes through faucet body 201. Accordingly, the required parts are reduced, and installation and maintenance are made easier.

The control device 100 may be installed in faucet water outlet 202 by means of thread, screw, etc. Water flows to water intake chamber 14 of housing 1 from the water pipe of automatic sensing faucet 200, then through water supplement hole 323 of diaphragm unit 32 to cavity 33 that is between diaphragm unit 32 and electromagnetic valve 31. Furthermore, water flows from water intake channel 316 of electromagnetic valve 31 to valve core 314 of electromagnet 31. At the initial position, electromagnetic valve 31 is shut, that is, valve core 314 of electromagnet 312 is positioned between water intake channel 316 and water leak channel 317. Water is impeded by valve core 314 of electromagnet 312, and can not flow to water leak channel 317 from water intake channel 316. Meanwhile, because the water capacity in cavity 33 is certain, under the pressure of the water, diaphragm unit 32 constantly stays between water intake chamber 14 and the third holding chamber 13. As such, water is sealed within water intake chamber 14 and electromagnetic valve assembly 3 and can not flow out through water discharge unit 4.

When objects are detected in the sensing area by the sensor, for example, a user's hands are detected in the sensing area of the faucet, the processor of circuit board 21 responds to the detected signal by causing electromagnetic valve 31 to turn on. After turning on electromagnetic valve 31, under the electromagnetic force, valve core 314 of electromagnet 312 will retract and cease blocking the connection between water intake channel 316 and water leak channel 317. Water reaches water leak channel 317 from water intake channel 316, and passes through small hole 325 and leak hole 15, then enters the third holding chamber 13 and is discharged from water discharge unit 4. Hence, the amount of water in cavity 33 is reduced. This causes the pressure to reduce on the side of diaphragm unit 32 that faces cavity 33. Under the act of the pressure, diaphragm unit 32 moves towards cavity 33 causing diaphragm unit 32 to cease blocking water intake chamber 14 and the third holding chamber 13. The water intake chamber 14 is connected to third holding chamber 13, so that water directly flows into the third holding chamber 13 from water intake chamber 14, and is discharged from water discharge unit 4, thus achieving the automatic water discharge from automatic sensing faucet 200.

When the sensor has detected the objects leaving the sensing area, for example, automatic sensing faucet 200 is no longer in use, the processor processes the detected signal to cause electromagnetic valve 31 to shut off. When the electromagnetic valve 31 is shut off, valve core 314 extends to the initial position and blocks the connection between water intake channel 316 and water leak channel 317. At the same time, water continues to flow into cavity 33 from water supplement hole 323 of diaphragm unit 32 but can not discharge through the water leak channel 317. Hence, the amount of water in cavity 33, which is between diaphragm unit 32 and electromagnetic valve 31, increases again, causing the sustained pressure of diaphragm unit 32 at the side facing the cavity 33 to be higher than at the side opposite the cavity 33. The diaphragm unit 32 is moved away from cavity 33. Therefore, diaphragm unit 32 again blocks the connection between water intake chamber 14 and third holding chamber 13, causing water to be sealed in the water intake chamber 14 and electromagnetic valve assembly 3. The water in the water intake chamber 14 can not flow into the third holding chamber 13. As described, it automatically causes the discharge or stoppage of water from the automatic sensing faucet 200.

The movement of the valve core 314 in electromagnetic valve 31 causes the water intake channel 316 and the water leak channel 317 to be connected or blocked. The movement of the diaphragm unit 32 causes the water intake chamber 14 and the third holding chamber 13 to be connected or blocked. Whether the electromagnetic valve 31 opens or shuts, it will cause the diaphragm unit 32 to move, in turn causing the third holding chamber 13 and the water intake chamber 14 to be connected or blocked. Accordingly, it achieves the discharge of water and the stopping of water discharge from unit 4, and ultimately achieves automatic water discharge and stopping of the automatic sensing faucet 200.

Control device 100 for automatic water discharge of the exemplary embodiment comprises sensor unit 2, electromagnetic valve assembly 3, and water discharge unit 4 which are assembled in housing 1, making the product more compact in structure and facilitating miniaturization. When control device 100 is installed in an apparatus for automatic water discharge, such as an automatic sensing faucet 200, it can be directly installed at the position of water outlet 202. Assembling control device 100 into an automatic water discharge apparatus facilitates installation, simplifies structure, and reduces the necessity of installation of additional, separate components, for example, electromagnetic valve assembly and controller assembly. The apparatus for automatic water discharge including an installed control device 100 is more compact in structure, easier to be installed and more convenient to be repaired and maintained.

Meanwhile, electromagnetic valve assembly 3 in the control device 100 for automatic water discharge of the present invention is smaller in volume and works more efficiently. The electromagnet 312 transversely lies in the valve cover 311 of the electromagnetic valve 31 and the diaphragm unit 32 is located under electromagnetic valve 31. The connection between water intake channel 316 and water leak channel 317 in the valve cover 311 may be blocked or unblocked by the movement of the valve core 314 of the electromagnet 312, which is controlled by the electromagnetic valve assembly 3 being opened or shut. In the embodiment shown, the opening and shutting of electromagnetic valve assembly 3 are realized by moving the valve core 314 of electromagnet 312 a short distance. If the valve core directly acted on the diaphragm unit, the valve core would need to move a longer distance as the diaphragm unit needs to move a longer distance. That results in low efficiency of electromagnetic valve and difficulty in reducing volume. Therefore, compared to such a configuration, the exemplary embodiment of the present invention can shorten the movement distance of the valve core 314 of the electromagnet 312 and increase the efficiency of electromagnetic force, thereby enabling the electromagnet 312 to be smaller in volume and ultimately enabling the electromagnetic valve assembly 3 to be smaller in volume. According to alternate embodiments, for example if large enough space is available, control device 100 for automatic water discharge can be configured to directly drives the diaphragm unit.

Further, installing the sensor unit 2 and the water discharge unit 4 into the front end of housing 1, and locating electromagnetic valve assembly 3 in the back end of housing 1 facilitates installation and manufacturing.

It is understood that the preceding description is given merely by way of illustration and not in limitation of the invention and that various modifications may be made thereto without departing from the spirit of the invention as claimed.

The invention claimed is:

1. A control device for automatic water discharge, mounted at a position where water is discharged from an automatic water discharge device, in a kitchen or sanitation environment, the control device comprising:

a housing comprising:

a front end and a back end opposite the front end;

a first holding chamber having an opening positioned at the front end of the housing;

a second holding chamber having an opening positioned at the back end of the housing;

a third holding chamber having an opening positioned at the front end of the housing; and a water intake chamber;

a sensor unit received in the first holding chamber and comprising a circuit with a processor and a sensor set at the circuit;

a diaphragm unit movable in a first direction;

an electromagnetic valve assembly received in the second holding chamber and comprising an electromagnetic valve electrically connected with the circuit and configured to control the motion of the diaphragm, the electromagnetic valve comprising an electromagnet set inside the valve cover such that an operative motion of the electromagnet is in a second direction that is transverse to the first direction; and a water discharge unit received in the third holding chamber;

wherein motion of the diaphragm unit controls connecting or blocking between the water intake chamber and the third holding chamber to respectively discharge water or stop water.

2. A control device for automatic water discharge according to claim 1, wherein the electromagnetic valve comprises a valve cover, the electromagnet disposed inside the valve cover;

wherein the electromagnet comprises a cylinder body, a valve core contained inside the cylinder body, and a coil set at two sides of the valve core; and wherein a cavity is formed between the valve cover and the diaphragm unit.

3. A control device for automatic water discharge according to claim 2, comprising a water intake channel connected with the cavity and a water leak channel connected with the third holding chamber are disposed in the valve cover;

wherein a movement of the valve core controls connecting and blocking between the water intake channel and the water leak channel.

4. A control device for automatic water discharge according to claim 3, wherein both the water intake channel and the water leak channel are positioned at the side of the valve cover adjacent to the valve core.

5. A control device for automatic water discharge according to claim 3, comprising a leak hole connected to both the second holding chamber and the third holding chamber is provided in the housing;

wherein the water leak channel is connected to the third holding chamber through the leak hole.

6. A control device for automatic water discharge according to claim 2, wherein the diaphragm unit comprises a moving diaphragm and a moving plate provided on the moving diaphragm; and wherein a water supplement hole connected with the cavity is disposed on the moving plate.

7. A control device for automatic water discharge according to claim 6, comprising a pin fitted with the water supplement hole is disposed on the diaphragm unit.

8. A control device for automatic water discharge according to claim 1, wherein the circuit comprises a first portion and a second portion, the sensor being disposed on the first portion and the processor being disposed on the second portion; and wherein the first portion of the circuit is positioned at a surface of the front end of the housing with the sensor facing towards a sensing area, and the second portion is positioned inside the first holding chamber.

9. A control device for automatic water discharge according to claim 8, wherein the circuit is set on a flexible circuit board.

10. A control device for automatic water discharge according to claim 1, wherein the water intake chamber is positioned at one side of the second holding chamber.

11. An apparatus for automatic water discharge comprising:

a control device for automatic water discharge set at a position where the water is discharged from the apparatus, the control device for automatic water discharge being connected with a water pipe of the apparatus for automatic water discharge and comprising:

a housing comprising a first holding chamber, a second holding chamber, a third holding chamber, and a water intake chamber connected with the water pipe;

a sensor unit contained in the first holding chamber;

a water discharge unit contained in the third holding chamber;

an electromagnetic valve assembly contained in the second holding chamber and comprising an electromagnetic valve having a valve cover and an electromagnet disposed inside the valve cover;

a diaphragm unit;

a cavity formed between the valve cover and the diaphragm unit;

a water intake channel connected with the cavity; and a water leak channel connected with the third holding chamber;

wherein the sensor unit comprises a circuit board provided with a processor and a sensor set at the circuit board for detecting if user enters/leaves a sensing area of the apparatus for automatic water discharge;

wherein the electromagnetic valve is electrically connected with the circuit board and operably coupled to the diaphragm unit, wherein motion of the diaphragm unit controls connecting and blocking between the water intake chamber and the third holding chamber to respectively discharge water or stop water; wherein the electromagnet is set inside the valve cover such that a direction of actuation of the electromagnet is transverse a direction of motion of the diaphragm unit; and wherein the water intake channel and the water leak channel are disposed in the valve cover and positioned at the side of the valve cover adjacent to the electromagnet.

12. An apparatus for automatic water discharge according to claim 11, wherein the electromagnet comprises a cylinder body, a valve core contained inside the cylinder body, and a coil set at two sides of the valve core.

13. An apparatus for automatic water discharge according to claim 12, wherein a movement of the valve core controls connecting and blocking between the water intake channel and the water leak channel.

14. An apparatus for automatic water discharge according to claim 13, comprising a leak hole connected to both the second holding chamber and the third holding chamber is provided at the housing;

wherein the water leak channel is connected to the third holding chamber by means of the leak hole.

15. An apparatus for automatic water discharge according to claim 13, wherein the water intake channel and the water leak channel are positioned at the side of the valve cover adjacent to the valve core.

16. An apparatus for automatic water discharge according to claim 12, wherein the diaphragm unit comprises a moving diaphragm and a moving plate provided on the moving diaphragm; and wherein a water supplement hole connected with the cavity is disposed on the moving plate.

17. An apparatus for automatic water discharge according to claim 16, wherein the diaphragm unit also comprises a pin fitted with the water supplement hole.

18. An apparatus for automatic water discharge according to claim 11, wherein the circuit board comprises a first portion and a second portion, the sensor being disposed on the first portion and the processor being disposed on the second portion; and wherein the first portion of the circuit board is positioned at a surface of a front end of the housing with the sensor facing towards the sensing area, and the second portion is positioned inside the first holding chamber.

19. An apparatus for automatic water discharge according to claim 11, wherein openings of the first and third holding chambers are positioned at a front end of the housing; openings of the second holding chamber and the water intake chamber are positioned at a back end of the housing; and the water intake chamber is positioned at one side of the second holding chamber.

20. An apparatus for automatic water discharge according to claim 11, wherein the apparatus for automatic water discharge is an automatic sensing faucet.

* * * * *